United States Patent [19]

Wiig

[11] 3,973,423

[45] Aug. 10, 1976

[54] BELT DRIVE SYSTEM FOR HIGH SPEED STRAIGHTENING MACHINES

[75] Inventor: Chester M. Wiig, Lincolnwood, Ill.

[73] Assignee: F. J. Littell Machine Company, Chicago, Ill.

[22] Filed: June 9, 1975

[21] Appl. No.: 584,771

[52] U.S. Cl. ..... 72/165

[51] Int. Cl.[2] ..... B21D 1/02

[58] Field of Search ..... 72/160–165

[56] References Cited

UNITED STATES PATENTS

| | | | |
|---|---|---|---|
| 2,315,446 | 3/1943 | Miller et al. | 72/160 X |
| 2,343,899 | 3/1944 | Groll et al. | 72/160 X |

*Primary Examiner*—Milton S. Mehr

[57] ABSTRACT

As heretofore manufactured, straightening machines have incorporated chain and sprocket drives and the straightening rolls have been geared together so as to rotate in unison. At high speeds the problems of lubrication on the plain roll bearings and as regards the chains and sprockets become increasingly more difficult. By using flexible belts and more particularly timing belts for driving the rolls of the straightening machine, the belt drive system of the invention eliminates the gears and also the speed reducing units as previously employed. Countershafts are driven from the drive motor by one or more flexible belts and other flexible belts are employed for driving the pinch rolls and the lower straightening rolls from the said countershafts.

12 Claims, 6 Drawing Figures

BELT DRIVE SYSTEM FOR HIGH SPEED STRAIGHTENING MACHINES

The invention relates to straightening machines for straightening metal supplied thereto in the form of a continuous strip and has reference more particularly to a new and improved belt drive system for high speed straighteners.

Feeding mechanism for continuous strip material has generally included straightening machines having pinch rolls for feeding and top and bottom rolls for straightening. Because the strip is unwound from a coil it is necessary to pass the same between the top and bottom rolls of a straightener to properly condition the strip before feeding the same to the press for punching, cutting or similar operations. In order to perform such operations, the upper set of rolls are movable bodily to and from the lower set of rolls. However as heretofore manufactured, the said straighteners incorporated a chain and sprocket drive and the rolls were geared together so as to rotate in unison at the same surface speed. When speeds exceed 200 feet per minute, the problem of lubrication on plain roll bearings and also as regards the chains, sprockets and gears becomes increasingly more difficult. The drive and the loop control problems are also more difficult.

Accordingly the main objective of the present invention is to provide a belt drive system for high speed straightening machines which will employ timing belt drives throughout, that is, from the drive motor to the intermediate countershafts and from said shafts directly to the pinch rolls and the lower straightening rolls. By using timing belts for the drives to said rolls it is possible to eliminate the gear wheels, the chains, the idler gears and the speed reducing units all as previously employed.

Another objective of the invention is to provide a belt drive system for high speed straighteners which will make use of timing belts for driving the countershafts, the pinch rolls and the lower rolls of the straightener, whereby it is possible to use sealed bearings on all said shafts and thus eliminate all lubricating equipment as heretofore used such as oil reservoirs, pans, splash guards and the like.

A further object resides in the provision of a belt drive system for high speed straighteners wherein flexible timing belts are employed for driving the countershafts from the drive motor and for driving the pinch rolls and also the lower straightener rolls from the countershafts, the timing belts for driving the lower straightening rolls being separate and independent from the timing belts for driving the pinch rolls.

Another object of the invention is to provide a belt drive system for high speed straightening machines of the character as described which will be highly efficient in operation, relatively simple in construction and economical to manufacture.

In the drawings which illustrate an embodiment of the new and improved belt drive system and wherein like reference characters are used to designate like parts, FIG. 1 is a side elevational view of a conventional feeding and straightening machine wherein the intemediate counter-shafts, the feeding pinch rolls and all the lower straightening rolls have enless flexible timing belt drives in accordance with the invention;

Figure 1:
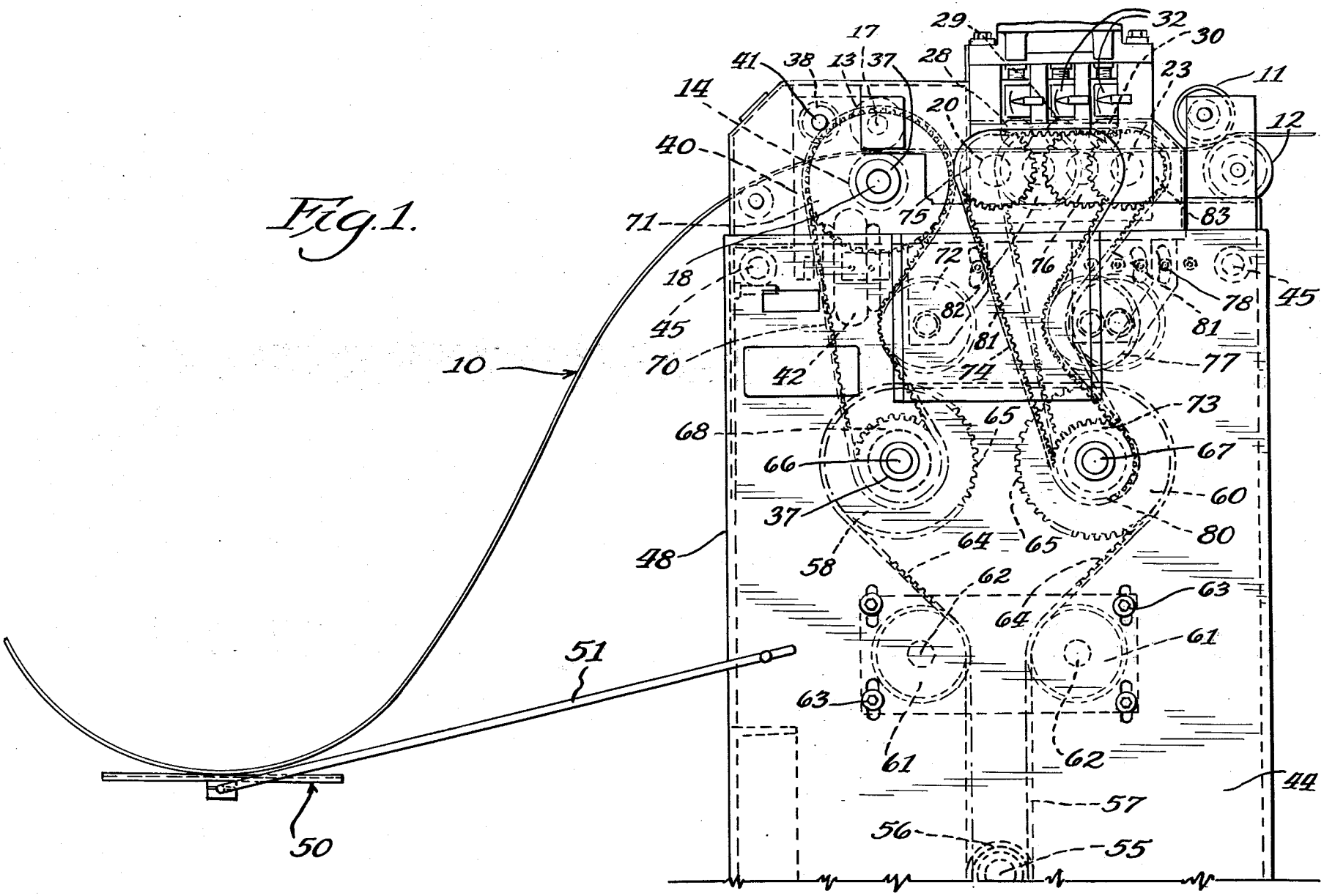
Figure 2:
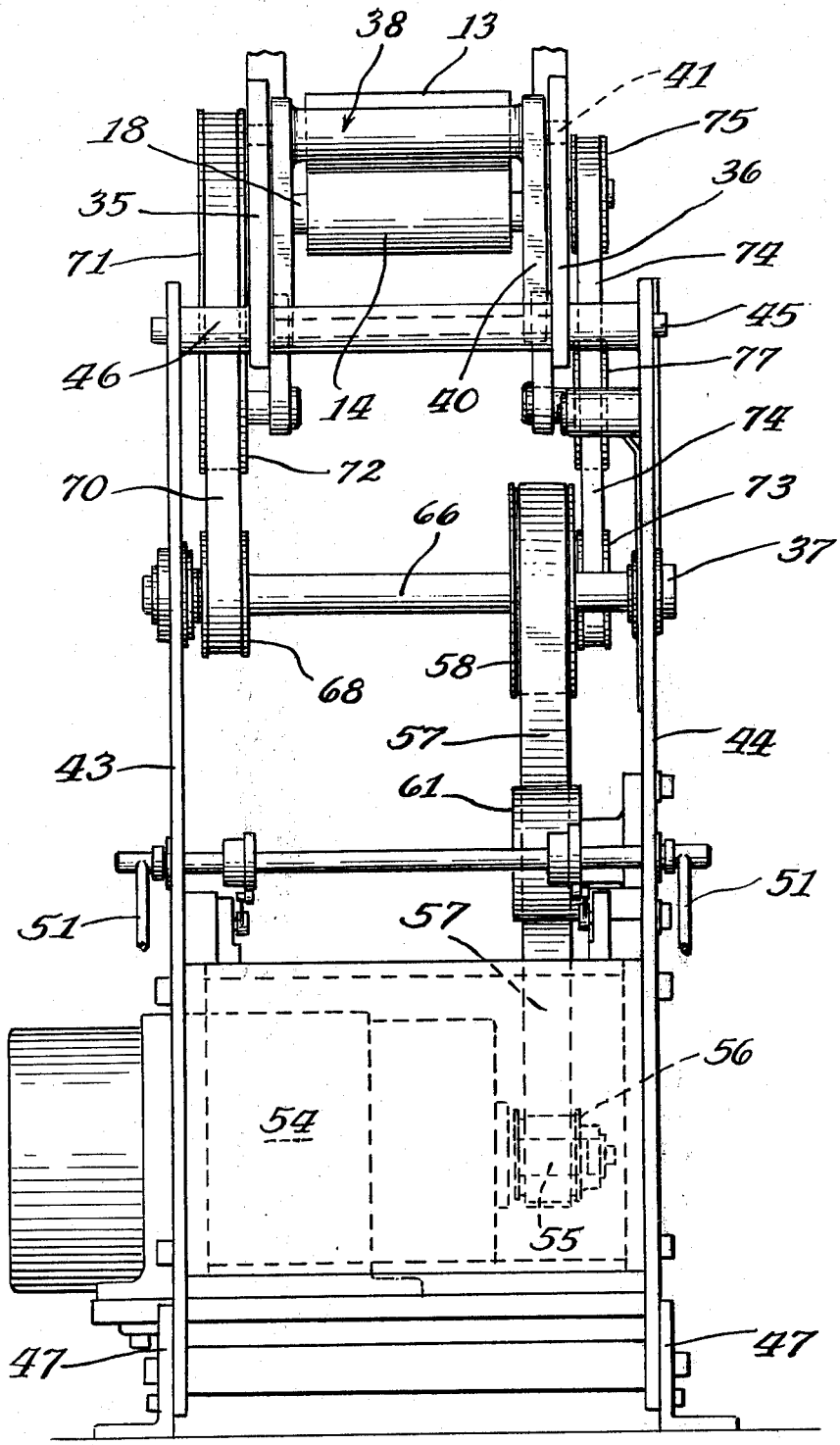
FIG. 2 is an elevational view of the exit end of the machine as shown in FIG. 1.
Figure 3:
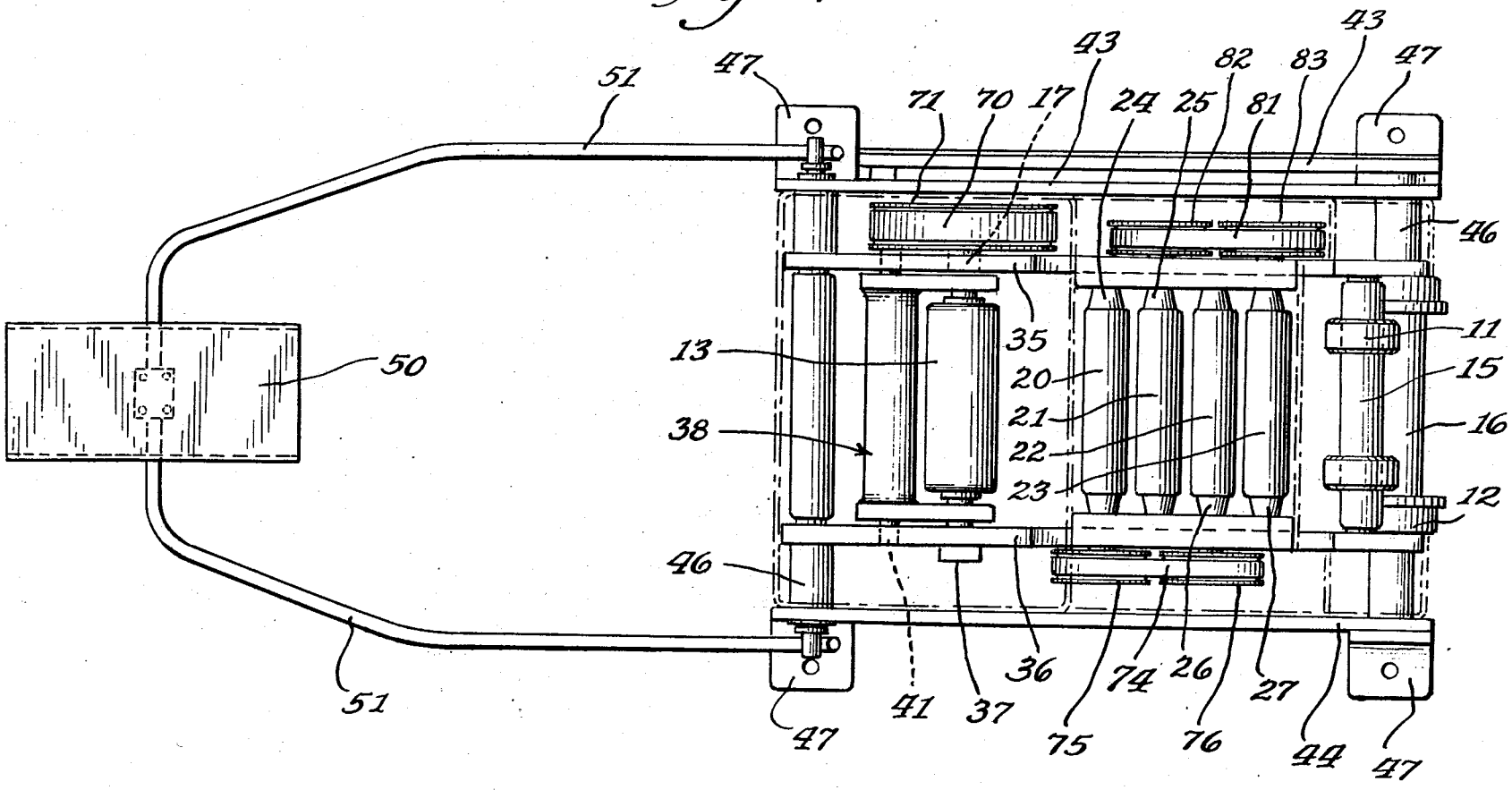
FIG. 3 is a top plan view looking down on the top of the machine of FIG. 1, and which clearly shows the entrance rollers for the strip material, the set of four lower straightening rolls driven by timing belts and the pressure regulated pinch rolls which are also driven by timing belts.

Referring to the drawings and in particular to FIGS. 1, 2 and 3 the machine shown is a conventional machine for straightening metal strip material such as 10, the same having entering rollers 11 and 12 at the entrance end and a pair of coacting pinch rolls 13 and 14 at the exit end. The entering rollers are fixed to and suitably journalled by the shafts 15 and 16 and the pinch rolls are also journalled by the shafts 17 and 18. Between the entering rollers and the pinch rolls, the machine is provided with four lower straightening rolls namely, 20,21,22 and 23, FIG. 3, journalled for rotation by the shafts 24,25,26 and 27. Said lower rolls have coaction with a set of three upper rolls namely 28,29 and 30, FIG 1, suitably supported for free rotation by the individual members 32 located on respective sides of the machine and which are movable vertically to and from the lower rolls for straightening purposes.

The shafts 15 and 16 for the entering rollers and the lower straightening roller shafts 24,25,26 and 27 are mounted in spaced frame members 35 and 36, FIG. 3, Also the shaft 18 for the lower pinch roll 14 is mounted in the spaced frames 35 and 36 and this shaft and all the others involved in a belt drive system are individually provided with lubrication-sealed bearings such as 37.

The top pinch roll 13 is journalled by the carrying arms of a yoke 38 having depending arms 40, the yoke being supported for pivotal movement by the pivot extensions 41, FIG. 1. The depending arms 40 coact with the pressure pad 42 and by applying air under pressure to said pad to inflate the same, the yoke can be actuated to provide the desired pressure for the pinch rolls 13 and 14.

The spaced frames 35 and 36 are suitably fixed to and supported by side frames 43 and 44 so as to form a unitary support for the straightening machine. Cross tie rods 45 are employed at respective corners together with tubular spacers 46 to fixedly secure the frames together and as a further supporting element the foot members 47 are provided.

The stock material in the form of a continuous strip of material will enter the straightener between the rollers 11 and 12 and then the strip will pass between the upper and the lower straightening rolls, all as identified, to finally exit from the machine between the pinch rolls 13 and 14. A loop of the stock material is formed beyond the front wall 48 and said loop rests upon the paddle control 50 supported by the pivot arms 51 for controlling the size of the loop.

The invention provides a new and improved belt drive system for the lower pinch roll 14, for the lower rolls 20,21,22 and 23 and also for countershafts to be described. Each belt drive system consists of an endlesss flexible timing belt passing over, that is around, spaced sprockets and for the drive to the countershafts reference is made to the motor 54 supported on the base portion of the frame structure 43,44,48 and said motor has a drive shaft 55 to which the sprocket 56 is secured. The endless flexible belt 57 passes around the drive sprocket 56 and around the larger sprockets 58 and 60. Proper tension is maintained on the flexible belt 57 by the idler wheels 61 journalled at 62 and being adjustable vertically at 63. The flexible timing belt 57 and all the other timing belts employed in the drive systems have a formation of gear teeth such as 64 on their inside surface. In a similar manner the drive sprocket 56 and the sprockets 58 and 60 have a formation of gear teeth 65 around their periphery and which mesh with the teeth of the flexible belt 57. It will be understood that all the sprockets involved in the belt drive systems have such a formation around their peripheries and which mesh with the teeth of their belt. The sprockets 58 and 60 are fixed to the countershafts 66 and 67 respectively mounted for rotation by sealed ball bearings such as 37 in the spaced frames 43 and 44. The motor thus drives the countershafts at the desired speed and additional timing belts and sprockets which will now be described transmit the rotary movement of the countershafts directly to the lower pinch roll 14 and to the lower straightening rolls 20,21,22 and 23.

Referring first to the countershaft 66 it will be seen that a second sprocket 68 is mounted on the said shaft and the flexible endless timing belt 70 operatively connects sprocket 68 with sprocket 71 on the shaft 18, FIG. 2, for the lower pinch roll 14. To maintain tension on the belt 70, an idler wheel 72 is provided. This endless belt drive from countershaft 66 to the lower pinch roll 14 is located on the left side of the machine as viewed in FIG. 2. By selecting the proper size for the sprockets 68 and 71, the desired surface speed for the pinch rolls can be obtained.

The invention contemplates similar timing belt drives for the lower straightening rolls. One such drive is located on the right side of the machine and the same includes the sprocket 73 on the countershaft 67, the flexible timing belt 74 and the sprockets 75 and 76 on shafts 24 and 26 for the rolls 20 and 22. Here again for maintaining tension on belt 74 an idler wheel is provided, such as 77 which is adjustable at 78. On the left side of the machine, FIG. 3, a similar timing belt drive is provided for the rolls 21 and 23. The sprocket 80 on countershaft 67 is operatively connected by the belt 81 to the sprockets 82 and 83 fixed to shafts 25 and 27. As thus described the drive system on the right side of the machine drives the lower rolls 20 and 22 directly from countershaft 67 and the drive system on the left side of the machine drives the rolls 21 and 23 directly from the same countershaft.

Figure 4:
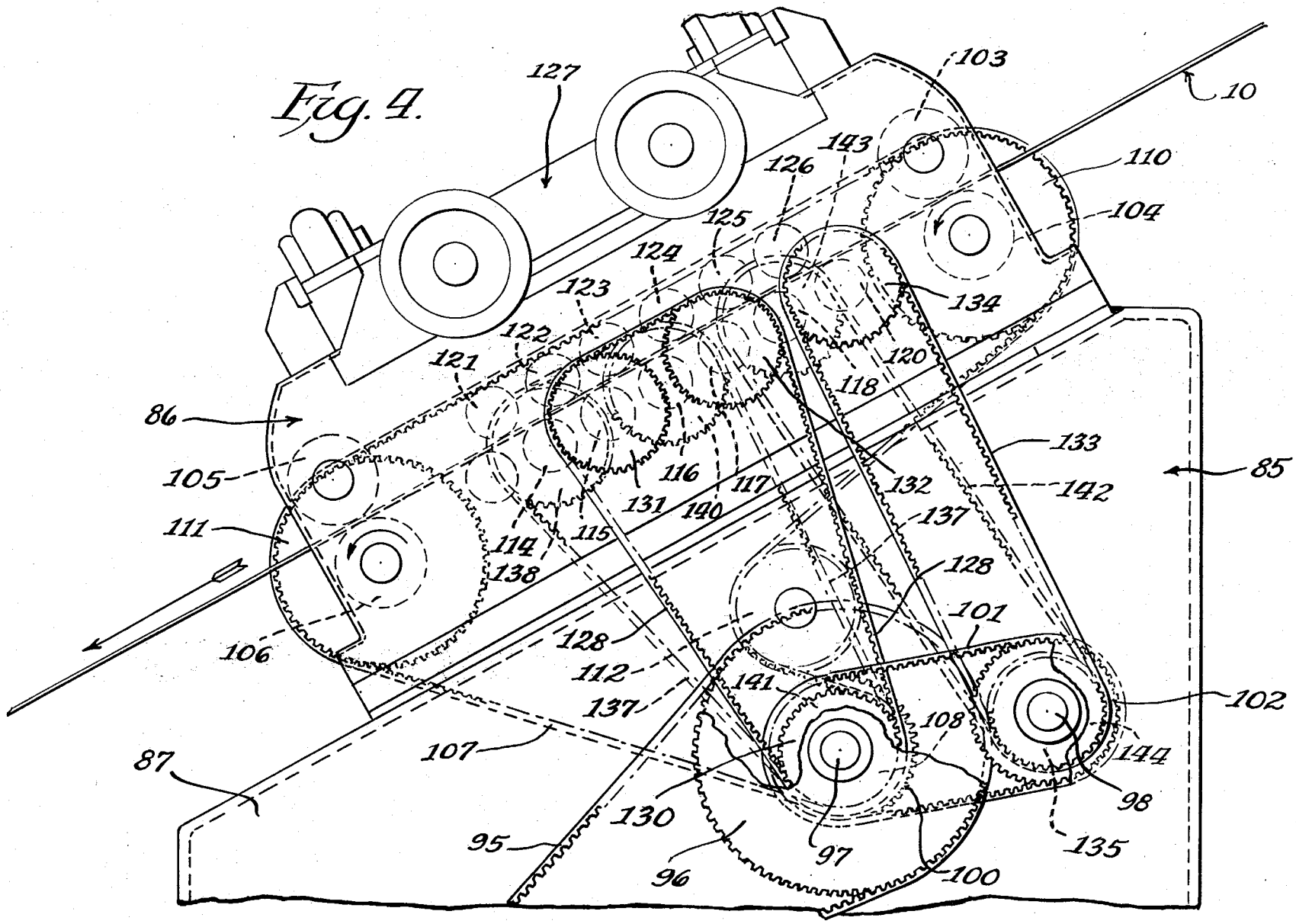
FIG. 4 is a schematic side elevational view of an improved form of straightener having front and rear pinch rolls, a set of six lower straightening rolls and a pair of countershafts, all having timing belt drives in accordance with the invention.
Figure 5:
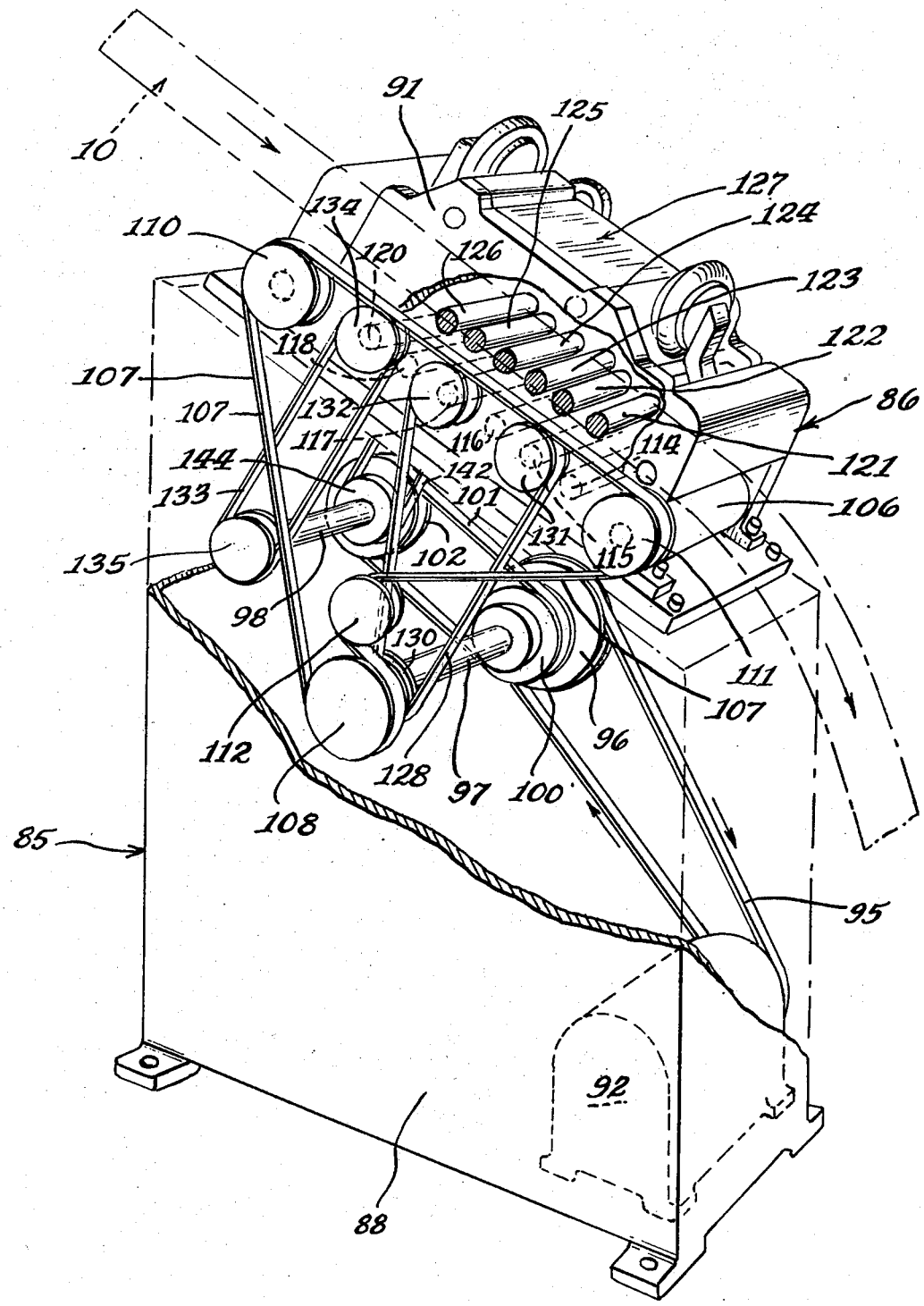
FIG. 5 is a schematic view in perspective showing flexible belt drives and pulleys on one side of the improved form of straightener as illustrated in FIG. 4.
Figure 6:
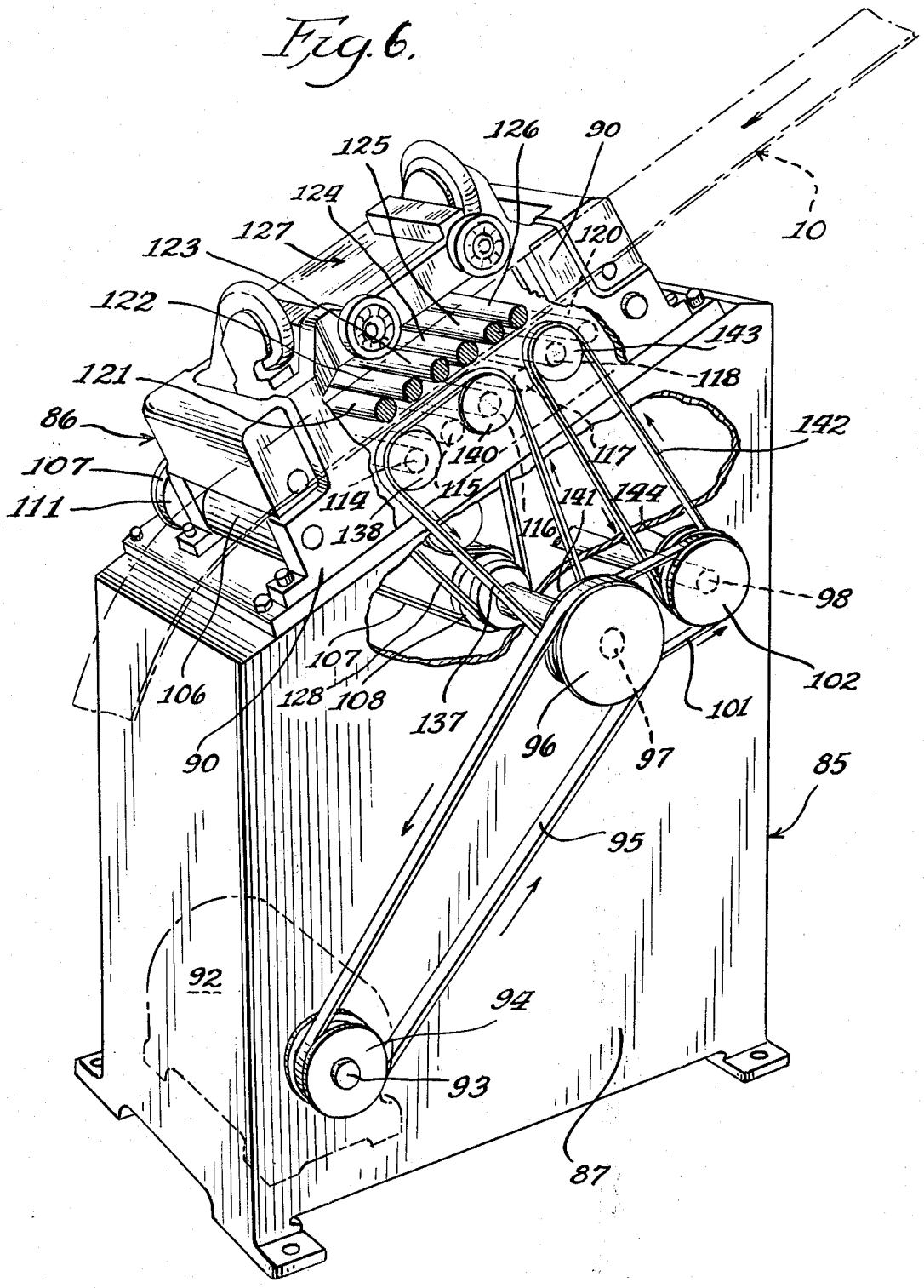
FIG. 6 is a schematic view in perspective similar to FIG. 5, but showing the flexible belt drives and pulleys on the opposite side of the straightener, all as contemplated by the invention.

The modification as shown in FIGS. 4,5 and 6 illustrates the invention as applied to a straightener having a pair of pinch rolls at both ends and having a set of six lower straightening rolls and a set of six upper rolls for coaction therewith. Although the several figures are somewhat schematic, the drives are shown in FIGS. 5 and 6 as including flexible belts passing around grooved pulleys, and wherein certain belts on one side of the machine drive certain straightening rolls with other belts on the opposite side driving the remaining straightening rolls. However the invention prefers the timing belts as described for FIGS. 1,2 and 3. Such timing belts are shown in FIG. 4. By using the timing belts, a more precise and correlated drive can be obtained, although the plain flexible belts and grooved pulleys will function in a manner that is satisfactory for some industry applications.

The frame of the straightening machine is indicated by numerals 85 and 86, the latter numeral indicating the frame for the pinch rolls, the lower straightening rolls and also the upper rolls. Frame structure 85 includes side frames 87 and 88 with the side frames 90 and 91 making up the structure 86. The drive motor 92 is located and suitably supported on the base of the structure 85, and the drive shaft 93 has the pulley or sprocket 94 fixed there to. Although a grooved pulley is shown in FIGS. 5 and 6, it will be understood that if timing belt drives are employed as in FIG. 4, then the pulley is replaced by a toothed sprocket. The flexible belt 95 passes around the sprocket 96 to drive the countershaft 97. Said countershaft is journalled in side frames 87 and 88 and lubrication sealed bearings are employed as previously described. In this modification the second countershaft 98 is driven from counter shaft 97 by the flexible belt drive including the sprocket 100 on countershaft 97, FIG 4, the flexible belt 101 and the sprocket 102 on countershaft 98.

The pinch rolls of the straightener are identified by the numerals 103,104 and 105,106 and the same are driven at the desired surface speed from the countershaft 97 by the flexible belt 107, which passes around the sprocket 108 on countershaft 97 and around the sprockets 110 and 111 on the shafts of the lower pinch rolls 104 and 106. Both lower pinch rolls are thus driven in unison and tension is maintained on belt 107 by the idler 112.

The straightener of FIGS. 4,5 and 6 has six lower straightener rolls 114,115,116,117 118 and 120 and the machine also has six upper rolls coacting therewith namely, 121,122,123,124,125 and 126. The set of upper rolls are movable to and from the lower straightening rolls by mechanism contained within the frame portion 127. As best shown in FIG. 5, the flexible belt drive for the lower straightening rolls 115 and 117 consists of the flexible belt 128 which passes around the sprocket 130 on countershaft 97 and around the sprockets 131 and 132 on the shafts of rolls 115 and 117. This belt drive is located on the right side, that is, the near side as shown in FIGS. 4 and 5. In accordance with the invention another flexible drive is located on this right side, namely the drive to lower roll 120 and which includes the flexible belt 133 which passes around the sprocket 134 on shaft of roll 120 and around the sprocket 135 on the countershaft 98. Thus the drive to the three rolls 115,117 and 120 is distributed to the two countershafts 97 and 98.

Similar belt drives are located on the opposite side of the straightener all as best illustrated in FIG. 6 and shown in dotted lines in FIG. 4. The belt 137 passes around the sprockets 138 and 140 on the shafts of rolls 114 and 116 and then around the pulley 141 on the countershaft 97. Likewise the single roll 118 similar to 120 is driven from the countershaft 98 by the belt 142 which passes over the sprocket 143 on the shaft of roll 118 and then around the sprocket 144 on the countershaft 98.

FIG. 4 shows the belt drive system of the invention as employing timing belts and sprockets, whereas in FIGS. 5 and 6 conventional flexible belts and pulleys are shown. thus the pulleys such as 96,102,110,111 and 131,132 and 134 have taken the place of the sprockets having the same number in FIG. 4. Also the timing belts of FIG. 4 such as 95,101,107,128 and 133 are shown as conventional flexible belts. Further to illustrate the versatility of the invention, the FIGS. 5 and 6 show the belt driving systems of FIG. 4 as transposed on opposite sides of the straightener. Thus the belt drive on the near side of FIG. 4 is shown in FIG. 5 as on the opposite side and the belt drive on the far side of FIG. 4 is shown in FIG. 6 as if it were on the opposite near side of the straightener of FIG. 4.

The flexible belt drives for the pinch rolls and for the lower straightening rolls of the machine as disclosed, and in particular the timing belt drives, makes possible the elimination of the driving gears and the idler gears as previously employed and also makes possible the use of lubrication-sealed bearings for all the shafts involved. Thus lubrication equipment such as oil reservoirs, aplash pans and the like can be eliminated. Also the flexible drives and the countershafts as employed in the present invention eliminates the speed reducing units as previously used. The speed of the straighteners can be increased to approximately 300 feat per minute due to the flexible belt drives and such speeds are now being demanded by the industry.

I Claim

1. In a drive for a feeding and straightening machine of the type having at least one pair of co-acting pinch rolls and a plurality of lower straightening rolls, individual shafts for journalling said pinch rolls and said straightening rolls respectively, a drive motor, a pair of countershafts also journalled for rotation and being located intermediate the drive motor and the lower straightening rolls, a timing belt drive operatively connecting the drive motor with the intermediate countershafts, a second timing belt drive for driving said pinch rolls from one of the countershafts, and other timing belt drives for driving the straightening rolls from said countershafts.

2. A drive for a feeding and straightening machine of the character as defined by claim 1, wherein the timing belt drives for the countershafts, the pinch rolls and the straightening rolls each include a continuous flexible belt having a formation of gear teeth on its inside surface and which coacts in a driving manner with spaced sprockets also having a formation of gear teeth around the periphery thereof and being adapted to mesh with those on the inside surface of the flexible belt.

3. A drive for a feeding and straightening machine of the character as defined by claim 1, additionally including a lubrication-sealed bearing at each end of the shafts which respectively journal the pinch rolls, the straightening rolls and the countershafts.

4. A drive for a feeding and straightening machine of the character as defined by claim 1, wherein certain of the straightening rolls are driven by timing belt drives located on one side of the machine, and wherein the remaining straightening rolls are driven by timing belt drives located on the opposite side of the machine.

5. A drive for a feeding and straightening machine of the character as defined by claim 1, additionally including a lubrication-sealed ball bearing at each end of the shafts which respectively journal the pinch rolls, the straightening rolls and the countershafts, and wherein certain of the straightening rolls are driven by timing belt drives located on one side of the machine with the remaining straightening rolls being driven by timing belt drives located on the opposite side of the machine.

6. In drive means for a feeding and straightening machine of the type having at least one pair of pinch rolls and a plurality of straightening rolls including an upper set which is movable bodily towards and from a lower set of said rolls, a drive motor, a pair of countershafts located between the drive motor and the set of lower straightening rolls, a flexible endless belt drive operatively connecting the motor with said countershafts, a second drive including a flexible endless belt for operatively connecting one of the countershafts with the pinch rolls, and a third drive also including a flexible endless belt for operatively connecting the other countershaft with the set of lower straightening rolls.

7. A drive for a feeding and straightening machine as defined by claim 6, additionally including a lubrication-sealed bearing at each end of the shafts which respectively journal the pinch rolls, the lower set of straightening rolls and the said countershafts.

8. A drive for a feeding and straightening machine as defined by claim 6, wherein the timing belt drives for the pinch rolls, the set of lower straightening rolls and the countershafts each include a continuous flexible belt having formation of gear teeth on its inside surface and which coacts in a driving manner with spaced sprockets also having a formation of gear teeth around the periphery thereof and being adapted to mesh with those on the inside surface of the flexible belt.

9. A drive for a feeding and straightening machine as defined by claim 6, wherein certain of the straightening rolls of the lower set are driven by timing belts located on one side of the machine, and wherein the remaining straightening rolls of said set are driven by timing belts located on the opposite side of the machine.

10. In a drive for a feeding and straightening machine of the type having at least one pair of pinch rolls and a plurality of straightening rolls including a set of lower rolls adapted to be driven, a drive motor, a pair of countershafts journalled for rotation and located between the drive motor and the lower straightening rolls, a flexible endless belt drive operatively connecting the motor with said countershafts for driving the same at the desired speed, an endless flexible belt passing around a pulley on one of the countershafts and around a pulley on the shaft of a lower pinch roll for rotating the same, a second endless flexible belt and a third such belt each passing around a pulley on one of the countershafts and around pulleys on at least two shafts of the lower straightening rolls for driving said rolls respectively, the second and third endless flexible belts being located on different sides of the straightener, and two additional endless flexible belts also on different sides of the straightener and each passing around a pulley on the shaft of a lower straightening roll and around a pulley on a countershaft for driving said rolls respectively, said last mentioned pulleys being located on the other of said countershafts.

11. A drive for a feeding and straightening machine of the type as defined by claim 10, wherein the endless felxible belts comprise timing belts having a formation of teeth on their inside surface, and wherein the pulleys are each replaced by a sprocket having a formation of teeth around the periphery thereof and which is adapted to mesh with its particular timing belt.

12. A drive for a feeding and straightening machine of the type as defined by claim 10, additionally including a lubrication sealed bearing at each end of the shaft for the lower pinch roll, at each end of the shafts for the lower straightening rolls and at each end of the countershafts.

* * * * *